US007647751B2

(12) United States Patent
Menta et al.

(10) Patent No.: US 7,647,751 B2
(45) Date of Patent: Jan. 19, 2010

(54) APPARATUS AND METHOD FOR ERECTING TOTE CONTAINERS

(75) Inventors: William J. Menta, West Wyoming, PA (US); Wojciech Biernacki, South Canaan, PA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/102,859

(22) Filed: Apr. 11, 2005

(65) Prior Publication Data

US 2005/0176567 A1 Aug. 11, 2005

Related U.S. Application Data

(63) Continuation of application No. 10/703,464, filed on Nov. 10, 2003, now abandoned.

(51) Int. Cl.
*B65B 43/24* (2006.01)
*B31B 1/06* (2006.01)

(52) U.S. Cl. ..... 53/457; 53/381.1; 53/382.1; 53/382.2; 493/181; 493/123

(58) Field of Classification Search ..... 493/55, 493/122, 123, 162, 183, 181; 53/457, 381.1, 53/382.1, 382.2, 382.3
See application file for complete search history.

(56) References Cited

U.S. PATENT DOCUMENTS 3,343,466 A * 9/1967 Sherman ..... 493/312
4,285,679 A * 8/1981 Wahle ..... 493/125
4,448,013 A * 5/1984 Nakajima ..... 53/565
4,509,312 A * 4/1985 Nakajima ..... 53/373.9
4,516,210 A * 5/1985 Dahlke ..... 700/127
4,516,381 A * 5/1985 Nakajima ..... 53/370.6
4,545,175 A 10/1985 Beckett
4,584,818 A 4/1986 Plaskett
4,627,217 A 12/1986 Plaskett
4,632,666 A * 12/1986 Ulrich et al. ..... 493/23
4,656,810 A 4/1987 Plaskett (Continued)

FOREIGN PATENT DOCUMENTS

FR 2697497 5/1994

*Primary Examiner*—Christopher Harmon
(74) *Attorney, Agent, or Firm*—Law Offices of Steven W. Weinrieb

(57) ABSTRACT

A new and improved apparatus or system for automatically assembling or erecting tote containers, and a corresponding method or process for practicing or implementing the assembly or erection of the tote containers, is disclosed wherein tote container workpieces are disposed in a serial array within a magazine or hopper. The tote container workpieces are serially and individually removed from the magazine or hopper, expanded from their FLATTENED states to their OPENED or EXPANDED states, and have their flap members folded upwardly and inwardly with respect to the lower or bottom edge portions of each tote container workpiece, in accordance with a predetermined procedural sequence, whereby each tote container is automatically assembled, as a result of the flap members being engaged with each other in an intermeshed, interengaged, and interlocked manner so as to effectively form the bottom support surface of the tote container without the need for fixing, bonding, or otherwise permanently securing the flap members together. As a result of such structure, each tote container is then capable of being used, and as may be subsequently desired or required, disassembled and reused.

17 Claims, 6 Drawing Sheets

U.S. PATENT DOCUMENTS 4,936,816 A 6/1990 Blumle et al.
5,007,889 A * 4/1991 Wakabayashi et al. ..... 493/316
5,102,382 A 4/1992 Center et al.
5,120,293 A 6/1992 Franklin
5,155,968 A * 10/1992 Mosse et al. ..... 53/64
5,234,398 A 8/1993 Larsen
5,352,178 A 10/1994 Pazdernik
5,415,613 A 5/1995 McGrath
5,454,776 A 10/1995 Ulrich et al.
5,514,068 A * 5/1996 Calvert et al. ..... 493/315
5,715,657 A * 2/1998 Mondani et al. ..... 53/457
5,826,408 A 10/1998 Ford
5,868,308 A 2/1999 Briand
5,876,319 A 3/1999 Holton
5,924,968 A 7/1999 Odenthal
5,997,459 A * 12/1999 Kruger et al. ..... 493/441
6,309,335 B1 10/2001 Holton
6,599,225 B2 7/2003 Ammons et al.
6,622,461 B2 9/2003 Gambetti
6,764,436 B1 7/2004 Mazurek

* cited by examiner

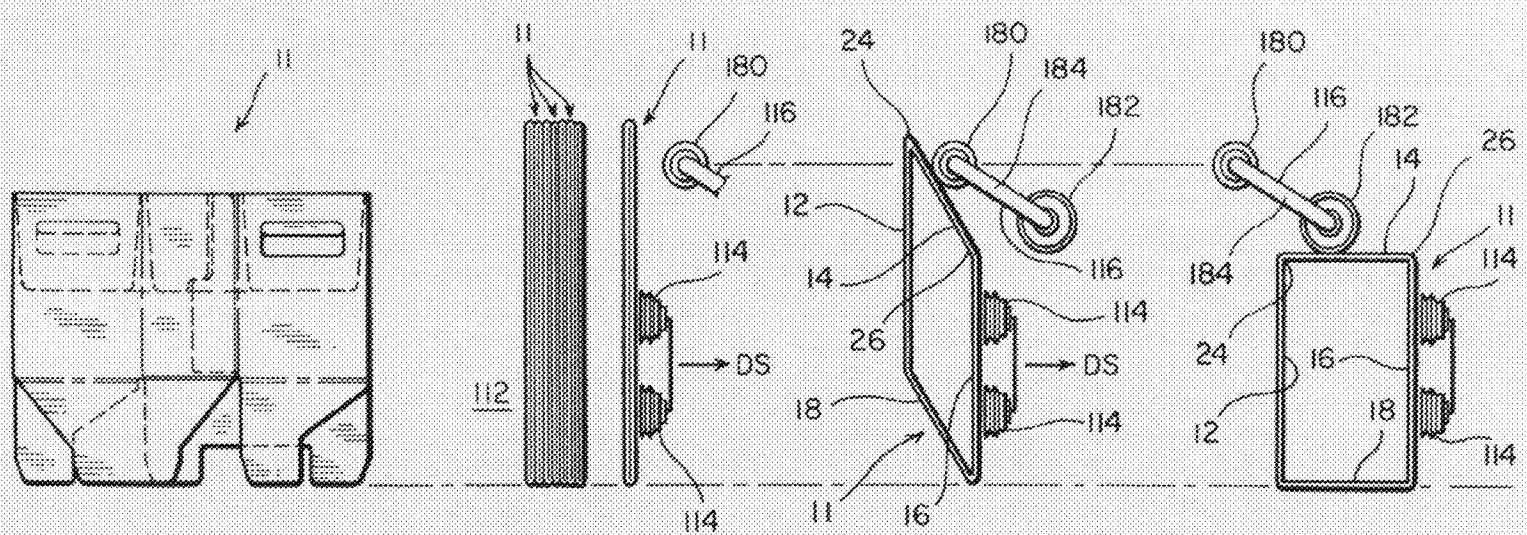
FIG. 3a
FIG. 3b
FIG. 3c
FIG. 3d
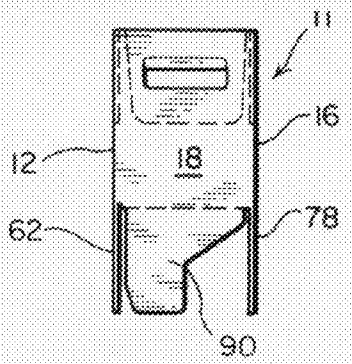
FIG. 3e

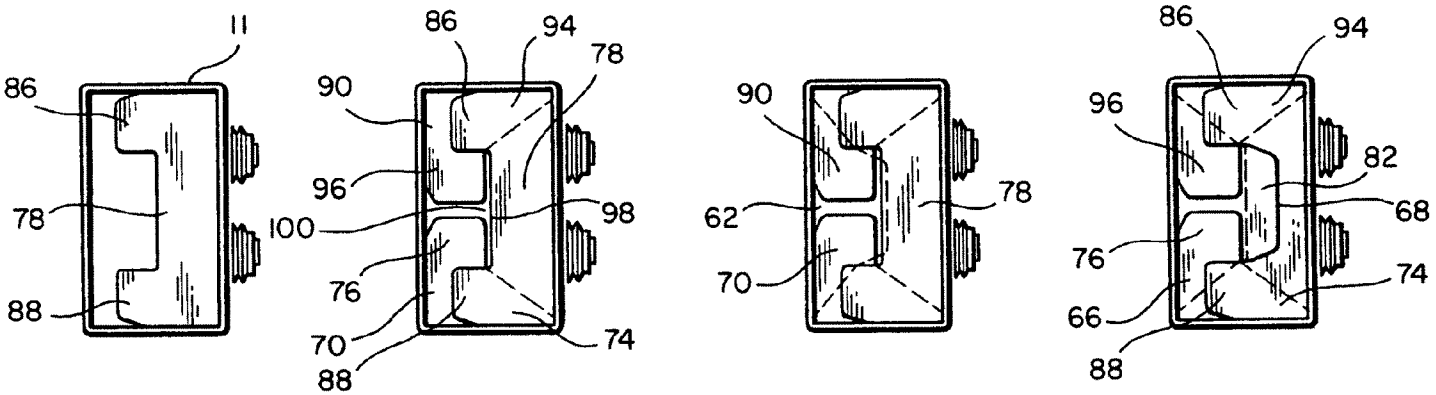
FIG. 4a
FIG. 5a
FIG. 6a
FIG. 7a
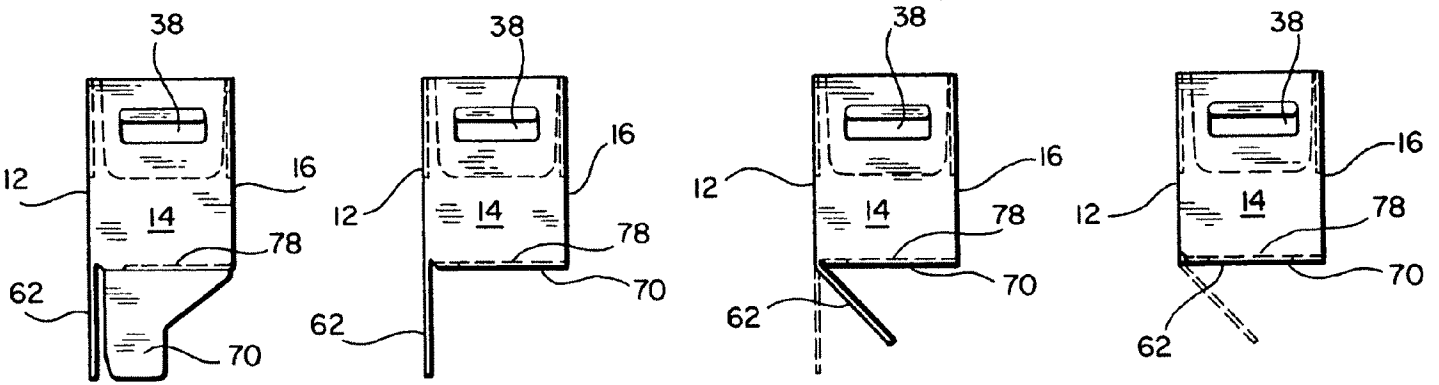
FIG. 4b
FIG. 5b
FIG. 6b
FIG. 7b

APPARATUS AND METHOD FOR ERECTING TOTE CONTAINERS

This patent application is a Continuation patent application of prior U.S. patent application Ser. No. 10/703,464, which was filed on Nov. 10, 2003 now abandoned.

FIELD OF THE INVENTION

The present invention relates generally to automatic article assembly or erection apparatus, and more particularly to a new and improved apparatus or system for automatically assembling or erecting tote containers, and a corresponding method or process for practicing or implementing the assembly or erection of the tote containers, wherein, in accordance with the new and improved apparatus or system, and the corresponding method or process, for assembling or erecting the tote containers, each tote container, fabricated from a suitable thermoplastic material and originally comprising a blank which is initially pre-formed into a FLATTENED tote container workpiece having two side walls, two end walls integrally connected to the two side walls, and four foldable flap members respectively integrally connected to the lower or bottom edge portions of the four integrally connected side and end walls, is positioned in a serial array, comprising a plurality of such tote container workpieces, which is disposed within a suitable magazine or hopper, such that each one of the plurality of tote container workpieces can be serially and individually removed from the magazine or hopper, expanded from its FLATTENED state to an OPENED or EXPANDED state, and have its flap members folded upwardly and inwardly with respect to the lower or bottom edge portions of the four integrally connected side and end walls of each tote container workpiece, in accordance with a predetermined procedural sequence, whereby each tote container is automatically assembled, as a result of the flap members being engaged with each other in an intermeshed, interengaged, and interlocked manner so as to effectively form the bottom support surface of the tote container without the need for fixing, bonding, or otherwise permanently securing the flap members together, and whereby further, each tote container is then capable of being used, and as may be subsequently desired or required, disassembled and reused.

BACKGROUND OF THE INVENTION

Tote containers are of course well-known in the container industry as comprising means for holding, storing, shipping, or displaying different or diverse types of articles or objects. Conventionally, most tote containers are fabricated from, for example, corrugated cardboard, and may comprise, for example, either a five-sided structure wherein the top of the container is open such that the contents disposed within the container are readily accessible, or alternatively, a six-sided structure wherein the top of the container must first be removed so as to in fact subsequently permit access to the contents disposed within the container. Corrugated cardboard tote containers have of course been utilized for years and have consistently demonstrated or exhibited sufficient, satisfactory, and adequate strength and structural integrity in connection with the performance of their basic functions, such as, for example, the holding, storing, shipping, and display of the different or diverse types of articles or objects. Corrugated cardboard tote containers, however, do have, or exhibit, several inherent operational disadvantages or drawbacks. For example, in order to erect such corrugated cardboard tote containers from corrugated cardboard blanks, the lower flap members, which are integrally attached to the bottom or lower edge portions of the four side and end walls of the corrugated cardboard blank, and which must be folded upwardly and inwardly with respect to the bottom or lower edge portions of the four side and end walls of the corrugated cardboard blank in order to effectively form the bottom support surface of the tote container, must be, for example, adhesively bonded or otherwise fixedly secured together so as to ensure the fact that the tote container retains its erected structural configuration.

Obviously, however, in view of the fact that such flap members are, for example, adhesively bonded or otherwise fixedly secured together, such fixedly erected structure militates against the disassembly of such tote containers when it is desired, for example, to transport, ship, or otherwise convey the tote containers to, for example, other locations, at which locations the tote containers can be re-assembled for subsequent uses or applications. In addition, in view of the fact that such conventional tote containers are fabricated from corrugated cardboard, if the tote containers should become wet, during, for example, shipping, storage, or use of the same in connection with the holding or displaying of the particular objects or articles, the structural integrity of the tote containers becomes seriously compromised. Accordingly, the tote containers can no longer assuredly or reliably perform their intended functions, whereby the articles or objects, originally disposed within the tote containers, might spoil or otherwise deteriorate, or alternatively, the articles or objects must be removed from the compromised tote containers and transferred to or deposited within new tote containers. In either case, it is apparent that conventional, corrugated cardboard tote containers do not necessarily comprise optimally cost-effective storage, shipping, and display containers.

Still yet further, it is additionally noted that while other conventional tote containers, such as, for example, those tote containers utilized by means of various postal or mail-handling organizations in connection with the holding, storage, or transportation of mail pieces or packages, may be fabricated from a suitable thermoplastic material, such tote containers are likewise permanently erected or assembled so as to likewise prevent, or militate against, the disassembly of the same for subsequent transportation, shipping, or conveyance to other locations, at which locations the tote containers can be re-assembled or re-erected for subsequent applications or uses. Lastly, while still other conventional tote containers have been fabricated from a suitable thermoplastic material and have been capable of disassembly, apparatus or systems do not currently exist for automatically erecting or assembling such tote containers whereby the erection or assembly processes must necessarily be performed or achieved manually wherein, understandably, such processes are time-consuming and fatiguing to personnel.

A need therefore exists in the art for a new and improved apparatus or system for automatically assembling or erecting tote containers, and a corresponding method or process for practicing or implementing the assembly or erection of the tote containers, wherein, in accordance with the new and improved apparatus or system, and the corresponding method or process, for assembling or erecting the tote containers, each tote container, fabricated from a suitable thermoplastic material and originally comprising a blank which is initially pre-formed into a FLATTENED tote container workpiece having two side walls, two end walls integrally connected to the two side walls, and four foldable flap members respectively integrally connected to the lower or bottom edge portions of the four integrally connected side and end walls, can be automatically expanded from its FLATTENED state to an OPENED or EXPANDED state, and wherein further, the flap members can be folded upwardly and inwardly, with respect to the lower or bottom edge portions of the four integrally connected side and end walls of each tote container workpiece, in accordance with a predetermined procedural sequence, whereby each tote container is automatically assembled, as a result of the flap members being engaged with each other in an intermeshed, interengaged, and interlocked manner so as to effectively form the bottom support surface of the tote container without the need for fixing, bonding, or otherwise permanently securing the flap members together, and whereby further, each tote container is then capable of being used, and as may be subsequently desired or required, disassembled and reused.

OBJECTS OF THE INVENTION

Accordingly, it is an object of the present invention to provide a new and improved apparatus or system for automatically assembling or erecting thermoplastic tote containers, and a corresponding method or process for practicing or implementing the assembly or erection of the thermoplastic tote containers.

Another object of the present invention is to provide a new and improved apparatus or system for automatically assembling or erecting thermoplastic tote containers, and a corresponding method or process for practicing or implementing the assembly or erection of the thermoplastic tote containers, which effectively overcome the various operational disadvantages and drawbacks characteristic of PRIOR ART tote containers and the apparatus and methods for assembling or erecting the same.

An additional object of the present invention is to provide a new and improved apparatus or system for automatically assembling or erecting thermoplastic tote containers, and a corresponding method or process for practicing or implementing the assembly or erection of the thermoplastic tote containers, wherein the flap members of the tote container workpiece can be folded upwardly and inwardly, with respect to the lower or bottom edge portions of the four integrally connected side and end walls of each tote container workpiece, in accordance with a predetermined procedural sequence, whereby each tote container is automatically assembled as a result of the flap members being engaged with each other in an intermeshed, interengaged, and interlocked manner so as to structurally form the bottom support surface of the tote container.

A further object of the present invention is to provide a new and improved apparatus or system for automatically assembling or erecting thermoplastic tote containers, and a corresponding method or process for practicing or implementing the assembly or erection of the thermoplastic tote containers, wherein the flap members of the tote container workpiece can be folded upwardly and inwardly, with respect to the lower or bottom edge portions of the four integrally connected side and end walls of each tote container workpiece, in accordance with a predetermined procedural sequence, whereby each tote container is automatically assembled as a result of the flap members being engaged with each other in an intermeshed, interengaged, and interlocked manner so as to structurally form the bottom support surface of the tote container without the need for fixing, bonding, or otherwise permanently securing the flap members together.

A last object of the present invention is to provide a new and improved apparatus or system for automatically assembling or erecting thermoplastic tote containers, and a corresponding method or process for practicing or implementing the assembly or erection of the thermoplastic tote containers, wherein the flap members of the tote container workpiece can be folded upwardly and inwardly, with respect to the lower or bottom edge portions of the four integrally connected side and end walls of each tote container workpiece, in accordance with a predetermined procedural sequence, whereby each tote container is automatically assembled as a result of the flap members being engaged with each other in an intermeshed, interengaged, and interlocked manner so as to structurally form the bottom support surface of the tote container without the need for fixing, bonding, or otherwise permanently securing the flap members together whereby each tote container is then capable of being used, and as may be subsequently desired or required, disassembled and reused.

SUMMARY OF THE INVENTION

The foregoing and other objectives are achieved in accordance with the teachings and principles of the present invention through the provision of a new and improved apparatus or system for automatically assembling or erecting tote containers, and a corresponding method or process for practicing or implementing the assembly or erection of the tote containers, wherein, in accordance with the new and improved apparatus or system, and the corresponding method or process, for assembling or erecting the tote containers, a plurality of tote container workpieces, each fabricated from a suitable thermoplastic material and originally comprising a blank which is initially pre-formed into a FLATTENED tote container workpiece having two side walls, two end walls integrally connected to the two side walls, and four foldable flap members respectively integrally connected to the lower or bottom edge portions of the four integrally connected side and end walls, are disposed in a serial array within a magazine or hopper. The tote container workpieces are individually removed from the magazine or hopper in a serial manner and each one of the tote container workpieces is then automatically expanded from its FLATTENED state to an OPENED or EXPANDED state.

Subsequently, the flap members are folded upwardly and inwardly, with respect to the lower or bottom edge portions of the four integrally connected side and end walls of each tote container workpiece, in accordance with a predetermined procedural sequence whereby each tote container is automatically assembled as a result of the flap members being engaged with each other in an intermeshed, interengaged, and interlocked manner so as to effectively form the bottom support surface of the tote container without the need for fixing, bonding, or otherwise permanently securing the flap members together. Accordingly, each tote container is then capable of being used, and as may be subsequently desired or required, in view of the fact that the flap members are not fixed, bonded, or otherwise permanently secured together, the tote containers may be readily disassembled by disengaging or unlocking the flap members from or with respect to each other. In this manner, the disassembled tote containers can be shipped to other locations at which, for example, the tote containers can be reused, or alternatively, the disassembled tote containers can effectively be recycled as a result of the thermoplastic tote containers being melted and re-fabricated when, for example, the structural integrity of the original tote containers may be compromised as a result of the original tote containers having effectively reached the ends of their service lives.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIGS. 3*a*-3*e* are schematic side elevational and top plan views showing the sequential steps of removing one of the tote container workpieces, as disclosed within FIG. 2, from the magazine or hopper and expanding the same from its FLATTENED state to its OPENED or EXPANDED state in preparation for the folding of the flap members, integrally connected to the lower or bottom edge portions of the four integrally connected side and end walls of the tote container workpiece, upwardly and inwardly with respect to each other, and with respect to the lower or bottom edge portions of the four integrally connected side and end walls of the tote container workpiece, so as to form the bottom support surface of the tote container;

FIGS. 4*a*-7*b* are schematic top plan and corresponding side elevational views showing the sequential folding of the flap members, integrally connected to the lower or bottom edge portions of the four integrally connected side and end walls of a tote container workpiece, similar to the tote container workpiece as disclosed within FIG. 3*e*, upwardly and inwardly with respect to each other, and with respect to the lower or bottom edge portions of the four integrally connected side and end walls of the tote container workpiece, whereby the upwardly and inwardly folded flap members are structurally engaged with each other in an intermeshed, interengaged, and interlocked manner so as to effectively form the bottom support surface of the tote container;

DETAILED DESCRIPTION OF THE PREFERRED EMBODIMENT

Figure 1:
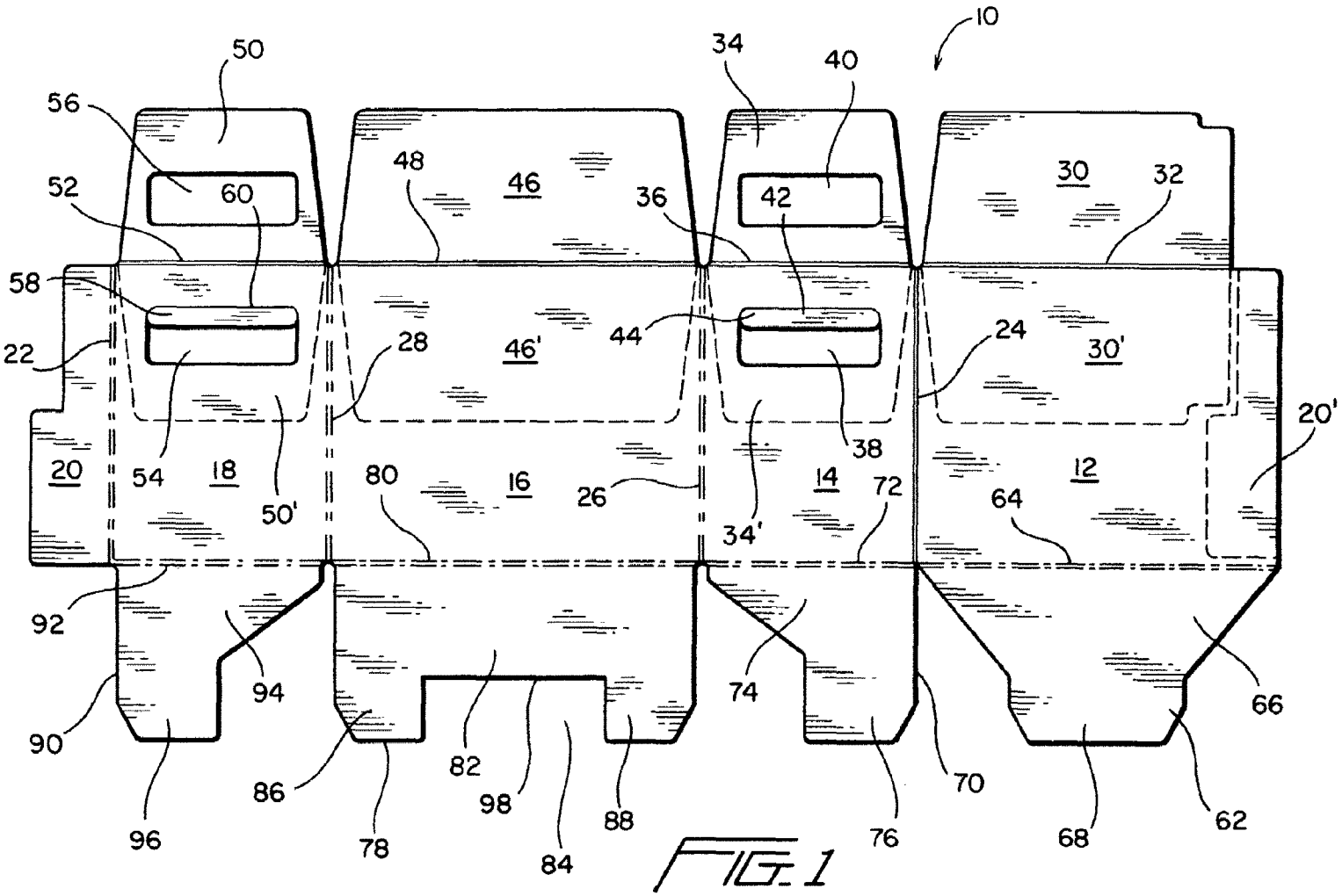
FIG. 1 is a side elevational view of a tote container blank showing the various components of the tote container prior to the assembly of the tote container blank into a tote container workpiece and the subsequent assembly of the tote container workpiece into the tote container.

Referring now to the drawings, and more specifically to FIG. 1 thereof, a tote container blank is disclosed and is generally indicated by the reference character 10. It is to be understood that the tote container blank 10 is to be assembled, in a manner to be discussed shortly hereinafter, into a tote container workpiece 11 as disclosed within FIG. 2, and in turn, the tote container workpiece 11 will be assembled into a tote container by means of the new and improved apparatus or system of the present invention, and in accordance with the assembly method of the present invention, as will also be discussed shortly hereinafter. More particularly then, and with reference therefore being initially made to FIG. 1, it is seen that the tote container blank 10 comprises a first rectangular side wall 12, a first rectangular end wall 14, a second rectangular side wall 16, and a second rectangular end wall 18. It is additionally seen that the second end wall 18 has a vertically oriented flap member 20 integrally connected thereto along a first vertically oriented score line 22, and in a similar manner, it is likewise appreciated that the first rectangular side wall 12 is integrally connected to the first rectangular end wall 14 along a second vertically oriented score line 24, the first rectangular end wall 14 is integrally connected to the second rectangular side wall 16 along a third vertically oriented score line 26, and the second rectangular side wall 16 is integrally connected to the second rectangular end wall 18 along a fourth vertically oriented score line 28.

Figure 2:
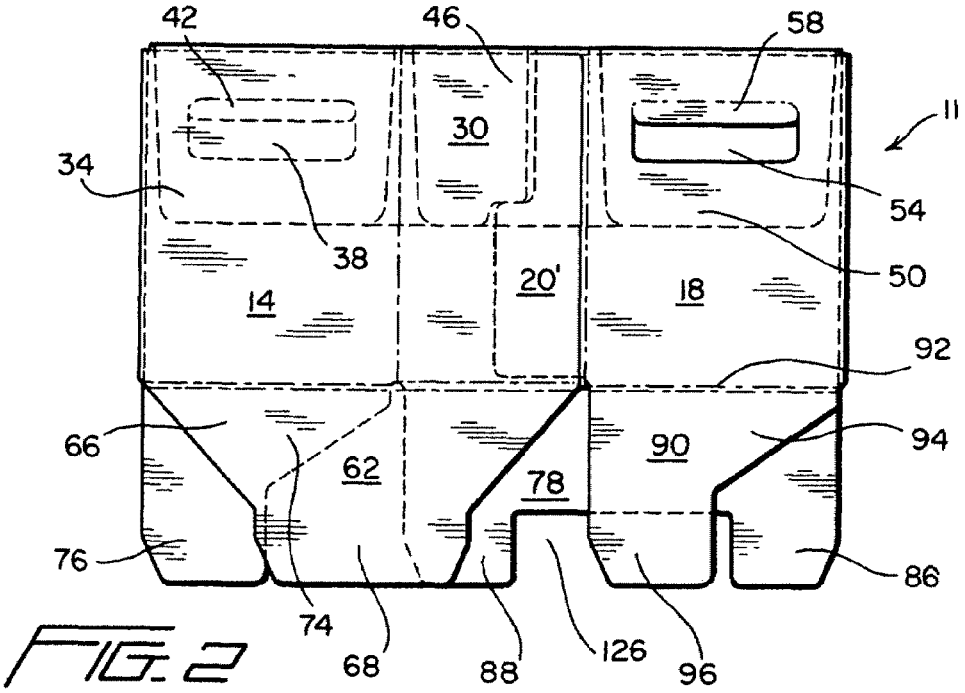
FIG. 2 is a side elevational view of a tote container workpiece which has been assembled from the tote container blank as illustrated within FIG. 1 and from which a tote container can be formed when the flap members, integrally connected to the lower or bottom edge portions of the four integrally connected side and end walls of the tote container workpiece, are folded upwardly and inwardly with respect to each other, and with respect to the lower or bottom edge portions of the four integrally connected side and end walls of the tote container workpiece, such that the upwardly and inwardly folded flap members can be engaged with each other in an intermeshed, interengaged, and interlocked manner so as to effectively form the bottom support surface of the tote container.

As has been noted hereinbefore, the tote container blank 10 is adapted to be assembled together so as to effectively form the tote container workpiece 11 as disclosed within FIG. 2, and when the tote container workpiece 11 is disposed in its EXPANDED or OPENED state, by means of the new and improved apparatus or system of the present invention, and in accordance with the assembly method of the present invention, the tote container workpiece 11 will have a substantially rectangular parallelepiped configuration. Accordingly, when the tote container blank 10 is assembled together so as to form the tote container workpiece 11, the external surface of the end flap member 20 will be, for example, adhesively bonded to the internal right side surface portion of the first rectangular side wall 12, as is shown in phantom at 20' in FIG. 1. In addition, when the tote container workpiece 11 is disposed in its OPENED or EXPANDED state, the first and second side walls 12, 16 will be disposed opposite each other, and in a similar manner, the first and second end walls 14, 18 will be disposed opposite each other. As can be further appreciated from FIG. 1, the first rectangular side wall 12 has a first reinforcing flap member 30 integrally connected to the upper edge portion of the first rectangular side wall 12 by means of a first horizontally oriented score line 32 wherein the first reinforcing flap member 30 is adapted to be folded downwardly with respect to the first rectangular side wall 12 so as to be, for example, adhesively bonded to the interior surface of the first rectangular side wall 12, as shown in phantom lines at 30', when the tote container blank 10 is assembled together so as to form the tote container workpiece 11 as disclosed within FIG. 2 in preparation for the ultimate formation of the tote container.

In a similar manner, the first rectangular end wall 14 has a second reinforcing flap member 34 integrally connected to the upper edge portion of the first rectangular end wall 14 by means of a second horizontally oriented score line 36 wherein the second reinforcing flap member 34 is adapted to be folded downwardly with respect to the first rectangular end wall 14 so as to likewise be, for example, adhesively bonded to the interior surface of the first rectangular end wall 14, as shown in phantom lines at 34', when the tote container blank 10 is assembled together so as to form the tote container workpiece 11 as disclosed within FIG. 2 in preparation for the ultimate formation of the tote container. It is to be additionally noted that the first rectangular end wall 14 has a substantially rectangularly configured through-aperture 38 formed within the upper region thereof, and that the second reinforcing flap member 34 is likewise provided with a similarly configured through-aperture 40 whereby, when the second reinforcing flap member 34 is folded downwardly with respect to the first rectangular end wall 14 and is adhesively bonded to the interior surface of the first rectangular end wall 14, as shown in the phantom lines at 34', the through-apertures 38, 40 will be aligned with respect to each other so as to effectively form a first handhold through which the fingers of personnel can be inserted when it is desired to, for example, grasp, lift, and move or transport the completed tote container. It is noted still further that an auxiliary flap member 42 is integrally formed within the upper region of the first rectangular end wall 14, and is integrally connected to the aforenoted upper region of the first rectangular end wall 14 by means of a horizontally oriented score line 44, so as to effectively be folded to a horizontal orientation whereby such auxiliary flap member 42 will operatively cooperate with those portions of the first rectangular end wall 14 and the second reinforcing flap member 34 which respectively define the through-apertures 38, 40 and thereby help define the aforenoted first handhold for operator personnel.

Continuing further, the second rectangular side wall 16 has a third reinforcing flap member 46 integrally connected to the upper edge portion of the second rectangular side wall 16 by means of a third horizontally oriented score line 48 wherein the third reinforcing flap member 46 is adapted to be folded downwardly with respect to the second rectangular side wall 16 so as to be, for example, adhesively bonded to the interior surface of the second rectangular side wall 16, as shown in phantom lines at 46', when the tote container blank 10 is assembled together so as to form the tote container workpiece 11 as disclosed within FIG. 2 in preparation for the ultimate formation of the tote container. In a similar manner, the second rectangular end wall 18 has a fourth reinforcing flap member 50 integrally connected to the upper edge portion of the second rectangular end wall 18 by means of a fourth horizontally oriented score line 52 wherein the fourth reinforcing flap member 50 is adapted to be folded downwardly with respect to the second rectangular end wall 18 so as to likewise be, for example, adhesively bonded to the interior surface of the second rectangular end wall 18, as shown in phantom lines at 50', when the tote container blank 10 is assembled together so as to form the tote container workpiece 11 as disclosed in FIG. 2 in preparation for the ultimate formation of the tote container.

It is to be additionally noted that, as was the case with the first rectangular end wall 14, the second rectangular end wall 18 has a substantially rectangularly configured through-aperture 54 formed within the upper region thereof, and that the fourth reinforcing flap member 50 is likewise provided with a similarly configured through-aperture 56 whereby, when the fourth reinforcing flap member 50 is folded downwardly with respect to the second rectangular end wall 18 and is adhesively bonded to the interior surface of the second rectangular end wall 18, as shown in the phantom lines at 50', the through-apertures 54, 56 will be aligned with respect to each other so as to effectively form a second handhold through which the fingers of personnel can likewise be inserted, as was the case with the first handhold, when it is desired to, for example, grasp, lift, and move or transport the completed tote container. It is additionally noted that an auxiliary flap member 58 is integrally formed within the upper region of the second rectangular end wall 18, and is integrally connected to the aforenoted upper region of the second rectangular end wall 18 by means of a horizontally oriented score line 60, so as to effectively be folded to a horizontal orientation whereby such auxiliary flap member 58 will cooperate with those portions of the second rectangular end wall 18 and the reinforcing flap member 34 which respectively define the through-apertures 54, 56 and thereby help define the aforenoted second handhold for the operator personnel.

With still further reference being made to FIG. 1, and in order to facilitate the formation, assembly, or erection of the tote container workpiece 11, as disclosed within FIG. 2, into the end product tote container in accordance with the new and improved tote container formation or erection method of the present invention, and by means of the new and improved tote container formation or erection apparatus or system of the present invention, it is seen that the first rectangular side wall 12 of the tote container blank 10 also has a first bottom surface flap member 62 integrally connected to the bottom or lower edge portion thereof by means of a fifth horizontally oriented score line 64 wherein the first bottom surface flap member 62 is adapted to be folded upwardly with respect to the first rectangular side wall 12 so as to partially form the bottom surface portion of the assembled or erected tote container when the tote container workpiece 11, as disclosed within FIG. 2, is utilized to assemble or erect the tote container in accordance with the new and improved assembly or erection method of the present invention and as achieved by means of the new and improved apparatus or system of the present invention. It is further appreciated that the first bottom surface flap member 62 has a unique geometrical configuration which comprises a substantially trapezoidal section 66 integrally connected at its relatively large-width proximal side to the first rectangular side wall 12 by means of the fifth horizontally oriented score line 64, and a substantially rectangular portion 68 which is integrally connected to the relatively small-width distal side of the trapezoidal section 66 of the first bottom surface flap member 62. In a similar manner, it is seen that the first rectangular end wall 14 of the tote container blank 10 also has a second bottom surface flap member 70 integrally connected to the bottom or lower edge portion thereof by means of a sixth horizontally oriented score line 72 wherein the second bottom surface flap member 70 is likewise adapted to be folded upwardly with respect to the first rectangular end wall 14 so as to also partially form the bottom surface portion of the assembled or erected tote container when the tote container workpiece 11, as disclosed within FIG. 2, is utilized to assemble or erect the tote container in accordance with the new and improved assembly or erection method of the present invention and as achieved by means of the new and improved apparatus or system of the present invention. In particular, it is further appreciated that the second bottom surface flap member 70 also has a unique geometrical configuration which comprises a substantially trapezoidal section 74 integrally connected at its relatively large-width proximal side to the first rectangular end wall 14 by means of the sixth horizontally oriented score line 72, and a substantially rectangular portion 76 which is integrally connected to the relatively small-width distal side of the trapezoidal section 74 of the second bottom surface flap member 70.

Continuing still further, the second rectangular side wall 16 of the tote container blank 10 has a third bottom surface flap member 78 integrally connected to the bottom or lower edge portion thereof by means of a seventh horizontally oriented score line 80 wherein the third bottom surface flap member 78 is adapted to be folded upwardly with respect to the second rectangular side wall 16 so as to also serve in partially forming the bottom surface portion of the assembled or erected tote container when the tote container workpiece 11, as disclosed within FIG. 2, is utilized to assemble or erect the tote container in accordance with the new and improved assembly or erection method of the present invention and as achieved by means of the new and improved apparatus or system of the present invention. As was the case with the first and second bottom surface flap members 62, 70, it is to be appreciated that the third bottom surface flap member 78 also has a unique geometrical configuration.

More particularly, the third bottom surface flap member 78 has a substantially C-shaped or U-shaped configuration, or considered alternatively, the third bottom surface flap member 78 comprises a substantially rectangular section 82 integrally connected along a first long proximal side thereof to the second rectangular side wall 16 by means of the seventh horizontally oriented score line 80, while a cut-out section 84 has been removed from the oppositely disposed long distal side thereof so as to define a pair of outwardly projecting, laterally spaced flap sections 86, 88. It is additionally noted that the width of the cut-out section 84 is slightly larger than the width dimension of the substantially rectangular portion 68 of the first bottom surface flap member 62, the significance of which will become readily apparent shortly hereafter.

It is lastly seen in connection with the structural make-up of the tote container blank 10 that the second rectangular end wall 18 of the tote container blank 10 also has a fourth bottom surface flap member 90 integrally connected to the bottom or lower edge portion thereof by means of an eighth horizontally oriented score line 92 wherein the fourth bottom surface flap member 90 is likewise adapted to be folded upwardly with respect to the second rectangular end wall 18 so as to also partially form the bottom surface portion of the assembled or erected tote container when the tote container workpiece 11, as disclosed within FIG. 2, is utilized to assemble or erect the tote container in accordance with the new and improved assembly or erection method of the present invention and as achieved by means of the new and improved apparatus or system of the present invention. In particular, it is to be appreciated that the fourth bottom surface flap member 90 is effectively a mirror image of the second bottom surface flap member 70 and accordingly has a unique geometrical configuration which comprises a substantially trapezoidal section 94 integrally connected at its relatively large-width proximal side to the second rectangular end wall 18 by means of the eighth horizontally oriented score line 92, and a substantially rectangular portion 96 which is integrally connected to the relatively small-width distal side of the trapezoidal section 94 of the fourth bottom surface flap member 90.

As may therefore be best appreciated from FIGS. 4*a*-7*b*, when the tote container workpiece 11, as illustrated within FIG. 2, has been expanded from its FLATTENED state to its OPENED state and is therefore ready to be erected or assembled into the finalized tote container product by means of the new and improved apparatus or system of the present invention, and in accordance with the new and improved method of the present invention, the third bottom surface flap member 78 will be the first bottom surface flap member to be folded upwardly and inwardly, through means of an angular displacement of 90° with respect to the seventh horizontally oriented score line 80, such that the third bottom surface flap member 78 will be moved from a substantially vertical orientation to a substantially horizontal orientation as can be appreciated from FIGS. 4*a* and 4*b*.Subsequently, as may best be appreciated from FIGS. 5*a* and 5*b*, the second and fourth bottom surface flap members 70, 90 are simultaneously folded upwardly and inwardly, through means of angular displacements of 90° with respect to the sixth and eighth horizontally oriented score lines 72, 92, such that the second and fourth bottom surface flap members 70, 90 will be moved from their substantially vertical orientations to substantially horizontal orientations. In this manner, the trapezoidal sections 74, 94 of the second and fourth bottom surface flap members 70, 90 will be disposed beneath the pair of outwardly projecting, laterally spaced flap sections 86, 88 of the third bottom surface flap member 78 so as to effectively retain the third bottom surface flap member 78 at its horizontal orientation when the tote container is disposed in its assembled condition.

As can best be appreciated from FIG. 5*a*, it is further seen that when the second and fourth bottom surface flap members 70, 90 are disposed beneath the pair of outwardly projecting, laterally spaced flap sections 86, 88 of the third bottom surface flap member 78, inner edge regions of the substantially rectangular portions 76, 96 of the second and fourth bottom surface flap members 70, 90 will be spaced from the inner edge portion 98 of the third bottom surface flap member 78 as at 100. In order to complete the assembly of the tote container, the first bottom surface flap member 62 is folded upwardly and inwardly, through means of three stepwise angular displacements of 45° each, with respect to the fifth horizontally oriented score line 64 such that during the first one of the 45° stepwise angular displacements or movements, the first bottom surface flap member 62 will be moved from its substantially vertical orientation to an angled orientation, as illustrated within FIGS. 6*a* and 6*b*, whereby the substantially trapezoidal section 66 of the first bottom surface flap member 62 begins to cover or overlap the second and fourth bottom surface flap members 70, 90. As the first bottom surface flap member 62 is subsequently folded further upwardly and inwardly, through means of the second one of the 45° stepwise angular displacements or movements, as illustrated within FIGS. 7*a* and 7*b*, the first bottom surface flap member 62 will be moved from its angled orientation to a substantially horizontal orientation whereby the substantially trapezoidal section 66 of the first bottom surface flap member 62 will now fully or completely cover or overlap the substantially rectangular portions 76, 96 of the second and fourth bottom surface flap members 70, 90.

As can additionally be appreciated from FIG. 7*a*, the substantially rectangular portion 68 of the first bottom surface flap member 62 overlaps the substantially rectangular section 82 of the third bottom surface flap member 78. In addition, it will be recalled that the width of the cutout section 84 of the third bottom surface flap member 78 is slightly larger than the width dimension of the substantially rectangular portion 68 of the first bottom surface flap member 62, and still further, that there is a space 100 defined between the inner edge regions of the substantially rectangular portions 76, 96 of the second and fourth bottom surface flap members 70, 90 and the inner edge portion 98 of the third bottom surface flap member 78.

Accordingly, when the first bottom surface flap member 62 is subsequently folded upwardly and inwardly still further with respect to the fifth horizontally oriented score line 64, through means of the third one of the 45° stepwise angular displacements or movements, the first bottom surface flap member 62 will be moved from its horizontal orientation to a substantially angled orientation internally within the tote container.

Accordingly, as the first bottom surface flap member 62 is subsequently folded still further upwardly and inwardly with respect to the fifth horizontally oriented score line 64, through means of the third one of the 45° stepwise angular displacements or movements, the substantially rectangular portion 68 of the first bottom surface flap member 62 will engage and be forcefully impressed into engagement with the substantially rectangular section 82 of the third bottom surface flap member 78 so as to effectively begin to force the third bottom surface flap member 78 upwardly and inwardly into the interior portion of the tote container and away from the second and fourth bottom surface flap members 70, 90. This upward and inward movement of the third bottom surface flap member 78 continues until the third bottom surface flap member 78 is moved sufficiently away from the second and fourth bottom surface flap members 70, 90 so as to effectively permit the substantially rectangular portion 68 of the first bottom surface flap member 62 to be disposed above the inner edge portion 98 of the third bottom surface flap member 78. Once the substantially rectangular portion 68 of the first bottom surface flap member 62 has effectively cleared the inner edge portion 98 of the third bottom surface flap member 78, the third bottom surface flap member 78 will spring or snap back to its unbiased horizontal orientation as a result of the inherent resiliency characteristic of the thermoplastic material from which the tote container blank 10 is fabricated as well as the inherent resiliency as effectively determined by means of the seventh horizontally oriented score line 80.

At this point in time, all four of the bottom surface flap members 62, 70, 78, 90 are intermeshed, interengaged, and interlocked with respect to each other as best illustrated within FIG. 7*a*. More particularly, it is seen that the pair of outwardly projecting, laterally spaced flap sections 86, 88 of the third bottom surface flap member 78 respectively overlap the trapezoidal sections 74, 94 of the second and fourth bottom surface flap members 70, 90, the substantially rectangular sections 76, 96 of the second and fourth bottom surface flap members 70, 90 respectively overlap opposite sides of the substantially trapezoidal portion 66 of the first bottom surface flap member 62, and the substantially rectangular portion 68 of the first bottom surface flap member 62 overlaps the substantially rectangular section 82 of the third bottom surface flap member 78. In this manner, the four bottom surface flap members 62, 70, 78, 90 are effectively locked together whereby the bottom surface of the tote container is formed and the tote container is disposed and retained in its assembled and erected state.

With reference now being made to FIGS. 3*a*-3*e*, and FIGS. 8-10, the new and improved apparatus or system which has been constructed in accordance with the principles and teachings of the present invention, and which implements the new and improved method of the present invention, so as to individually and serially remove a plurality tote container workpieces from a magazine or hopper, so as to expand each tote container workpiece from its FLATTENED state to its OPENED or EXPANDED state, and to respectively automatically assemble or erect each tote container from one of the tote container workpieces, is disclosed and is generally indicated by the reference character 110. As initially shown, for example, in FIGS. 3*a*-3*e*, a single tote container workpiece 11, as has been illustrated and detailed within FIG. 2, is disclosed or illustrated within FIG. 3*a* as being in its FLATTENED state, and a plurality or serial array of such tote container workpieces 11, as disposed in their FLATTENED states, are disclosed within FIG. 3*b* so as to effectively simulate a supply of such tote container workpieces 11 as they are disposed or contained within a tote container workpiece magazine or hopper 112 as is more particularly illustrated or disclosed within FIGS. 8-10. As is also disclosed or illustrated within FIG. 3*b*, as well as within FIG. 8-10, a vacuum suction cup assembly, comprising a plurality of vacuum suction cup implements 114, is operatively associated with the downstream end of the tote container workpiece magazine or hopper 112 so as to effectively withdraw or remove the leading one of the tote container workpieces 11 from the forward or open end of the tote container workpiece magazine or hopper 112 as the vacuum suction cup assembly is moved in the direction denoted by means of the arrow DS. Still further, as is additionally disclosed within FIGS. 3*c* and 3*d*, as well as within FIG. 9, a dual roller mechanism 116 is also operatively associated with, or disposed within the vicinity of, the forward or open end of the tote container workpiece magazine or hopper 112. In this manner, as the vacuum suction cup implements 114 effectively withdraw or remove the leading one of the tote container workpieces 11 from the forward or open end of the tote container workpiece magazine or hopper 112, the tote container workpiece 11 will effectively be opened from its FLATTENED state to its EXPANDED state, as a result of the tote container workpiece 11 encountering the dual roller mechanism 116 as disclosed within FIGS. 3*c*-3*d*, in preparation for the transformation of the tote container workpiece 11 into the desired finalized assembled or erected tote container.

Figure 10:
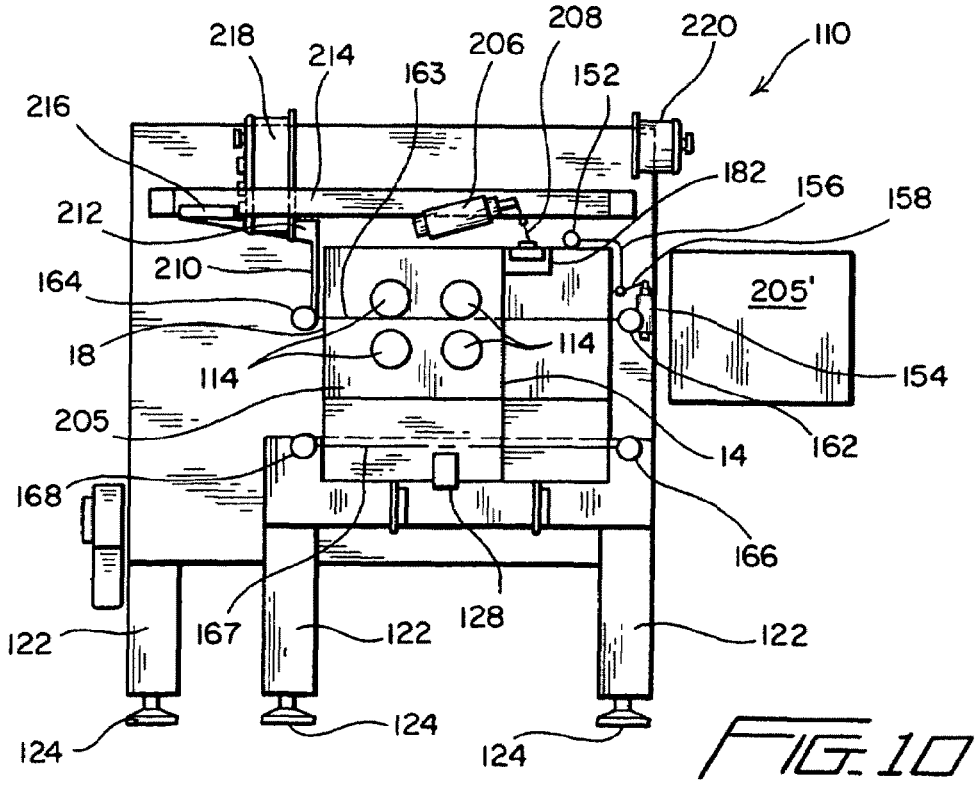
FIG. 10 is an end elevational view of the new and improved apparatus or system constructed in accordance with the principles and teachings of the present invention and corresponding to the apparatus or system as disclosed within FIGS. 8 and 9.
Figure 8:
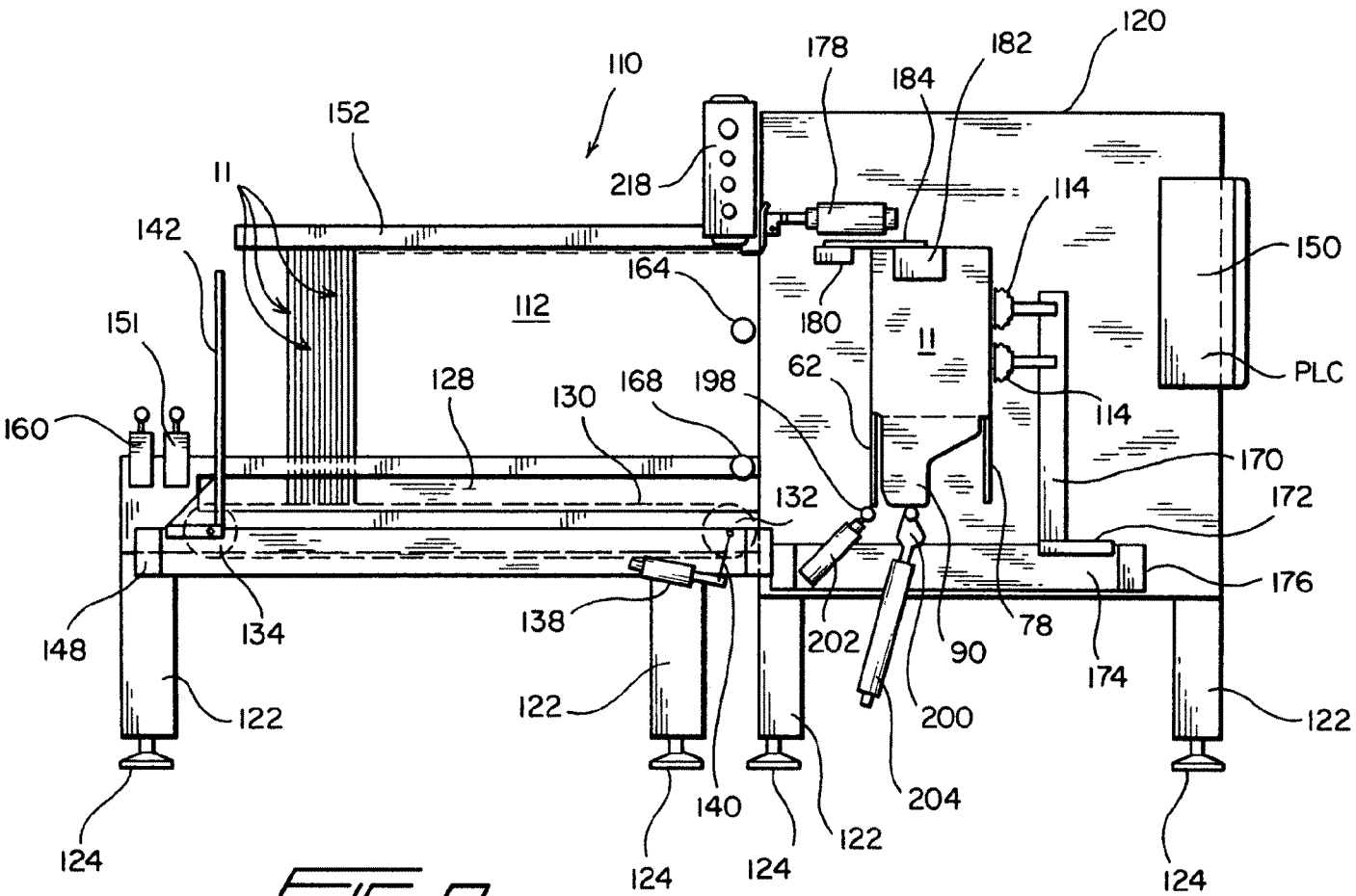
FIG. 8 is a side elevational view of the new and improved apparatus or system, constructed in accordance with the principles and teachings of the present invention, for individually removing the tote container workpieces from the magazine or hopper and for expanding each tote container workpiece from its FLATTENED state to its OPENED or EXPANDED state, as has been schematically illustrated within FIGS. 3*a*-3*e*, and for automatically assembling or erecting the tote containers by folding the flap members of the tote container workpiece upwardly and inwardly, with respect to each other and with respect to the lower or bottom edge portions of the four integrally connected side and end walls of each tote container workpiece, such that the flap members are engaged with each other in an intermeshed, interengaged, and interlocked manner so as to structurally form the bottom support surface of the tote container.
Figure 9:
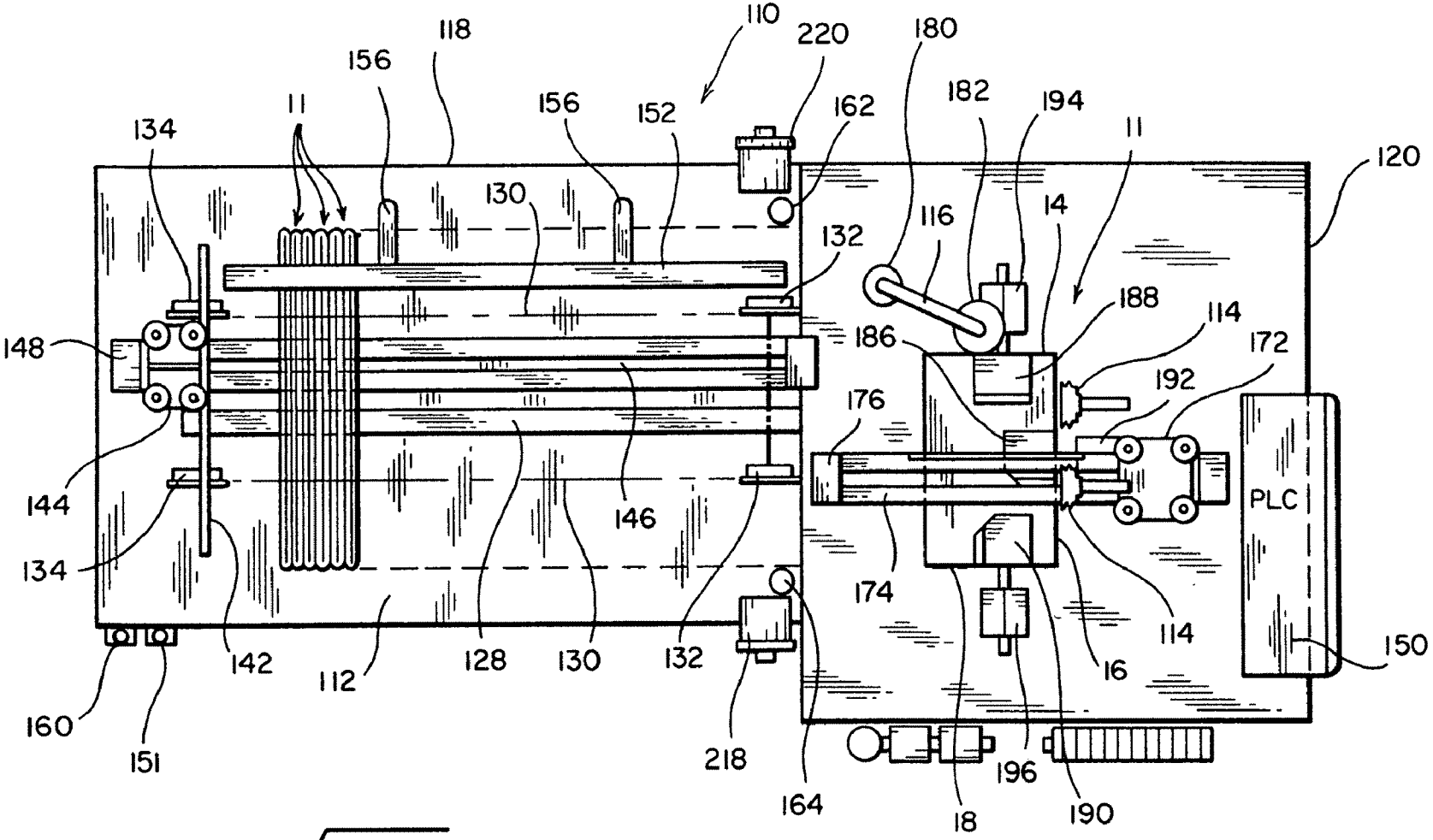
FIG. 9 is a top plan view of the new and improved apparatus or system constructed in accordance with the principles and teachings of the present invention and corresponding to the apparatus or system as disclosed within FIG. 8.

With reference therefore being particularly made to FIGS. 8-10, the details of the various components that comprise the new and improved apparatus or system which has been developed or constructed in accordance with the teachings and principles of the present invention, and which operably cooperate together so as to implement the new and improved method of the present invention for individually and serially removing the plurality of tote container workpieces 11 from the tote container workpiece magazine or hopper 112, for expanding each tote container workpiece 11 from its substantially FLATTENED state to its OPENED or EXPANDED state, and for automatically assembling or erecting the tote containers from respective ones of the tote container workpieces 11, will now be described. More particularly, as can best be seen in FIGS. 8 and 9, a plurality of tote container workpieces 11 are disposed within the tote container workpiece magazine or hopper 112 so as to be arranged within a serial array. The tote container workpiece magazine or hopper 112 is disposed within a housing 118, and the magazine or hopper framework or housing 118 is, in turn, disposed upon a machine or system framework or housing 120. The machine or system framework or housing 120 is mounted upon a plurality of support legs 122, and each support leg 122 has an leveling pad 124 adjustably mounted within the lowermost end portion thereof whereby not only can the machine or system framework or housing 120 be appropriately leveled, but in addition, the elevational disposition of the machine or system framework or housing 120 can be adjusted or altered as may be necessary.

In order to serially convey the plurality or array of tote container workpieces 11 within and through the tote container workpiece magazine or hopper 112, each one of the tote container workpieces 11 must be disposed in the positional orientation as disclosed within FIGS. 2 and 3*a*, that is, with the bottom surface flap members 62, 70, 78, 90 extending vertically downwardly. In addition, it is also critically important, in connection with the successful assembly or erection of each tote container, that each one of the tote container workpieces 11 is disposed within the tote container workpiece magazine or hopper 112 in a predetermined front-to-back orientation such that when each one of the tote container workpieces 11 is in fact opened from its substantially FLATTENED state to its EXPANDED state as disclosed, for example, within FIGS. 3*c*-3*d*, each tote container workpiece 11 will be positioned as disclosed within FIGS. 3*e*, 4*b*, and 8 so as to enable the bottom surface flap members 62, 70, 78, 90 to in fact be folded with respect to each other in accordance with the particularly unique sequence as has been previously described in connection with the disclosures of FIGS. 4*a*-7*b*.

Accordingly, in order to ensure the aforenoted proper orientation of the plurality of tote container workpieces 11 within the tote container workpiece magazine or hopper 112, it is to be appreciated, as can best be seen in FIG. 2, that when each tote container workpiece 11 is disposed in its FLATTENED state, a slot 126 is effectively defined between the flap section 88 of the bottom surface flap member 62 and the flap portion 96 of the bottom surface flap member 90. It is to be appreciated that the slot 126 is effectively disposed at a rightward, off-center position with respect to the lateral extent or width dimension of each tote container workpiece 11, and still further, a tote container workpiece orientation bar 128 is fixedly mounted within the tote container workpiece magazine or hopper 112 at a similar, rightward, off-center position as can best be seen in FIGS. 8-10. Accordingly, when the plurality of tote container workpieces 11 are disposed within the tote container workpiece magazine or hopper 112 in accordance with the aforenoted predetermined orientation wherein the bottom surface flap members 62, 70, 78, 90 extend vertically downwardly, the tote container workpieces 11 will also necessarily have a predetermined front-to-back orientation, so as not to be loaded into the tote container workpiece magazine or hopper 112 in a reversed or backwards mode, as a result of the proper positional alignment defined between the slot 126 of each tote container workpiece 11 and the tote container workpiece orientation bar 128. It is further appreciated that the presence of the tote container workpiece orientation bar 128 within the tote container workpiece magazine or hopper 112, and its interaction with the plurality of tote container workpieces 11 through means of the slot structure 126, likewise prevents the tote container workpieces 11 from moving laterally or transversely within the tote container workpiece magazine or hopper 112.

In order to achieve the forward movement of the plurality of serially arranged tote container workpieces 11 within and through the tote container workpiece magazine or hopper 112, a pair of laterally spaced conveyor drive chain mechanisms 130, 130 are disposed within the bottom region of the tote container workpiece magazine or hopper 112, and it is noted that the pair of laterally spaced conveyor drive chain mechanisms 130, 130 are routed around a pair of forwardly disposed powered pulleys 132, 132, and a pair of rearwardly disposed idler pulleys 134, 134. The powered pulleys 132, 132 are operatively interconnected together by means of a transversely extending axle 136, and the powered pulleys 132, 132 are adapted to be incrementally or indexably moved by means of a pneumatically-powered indexable or ratcheting clutch-type piston-cylinder mechanism 138 which is operatively connected to the right side powered pulley 132 by means of a suitable crank lever 140 as disclosed in FIG. 8. As can also be appreciated from, for example, FIGS. 2, 8, and 9, the lower or bottom edge portions of, for example, the bottom surface flap members 62 and 90 are disposed atop the drive chain mechanisms 130, 130. Accordingly, as the drive chain mechanisms 130,130 are indexably advanced, the serial array of tote container workpieces 11 will likewise be advanced within and through the tote container workpiece magazine or hopper 112.

In conjunction with the aforenoted movement of the plurality of tote container workpieces 11 within and through the tote container workpiece magazine or hopper 112 by means of the indexable drive chain mechanisms 130, 130, it can be readily appreciated that if additional driving or moving means was not provided so as to operatively cooperate with the drive chain mechanisms 130, 130, the plurality of tote container workpieces 11 could not necessarily be maintained in their vertically upright orientation within the tote container workpiece magazine or hopper 112 so as to ultimately permit the bottom surface flap members 62, 70, 78, 90 to be properly engaged and folded upwardly and inwardly as has been previously disclosed and described within FIGS. 4*a*-7*b*. Accordingly, a vertically oriented pusher-plate mechanism 142 is disposed internally within the tote container workpiece magazine or hopper 112 so as to be engageable with the rear surface portion of the rearwardmost one of the plurality of serially arrayed tote container workpieces 11. The pusher-plate mechanism 142 is mounted upon a slide mechanism 144, and the slide mechanism 144 is slidably mounted upon a track member 146 which is effectively defined within the upper surface portion a pneumatically powered rodless cylinder mechanism 148. Actuation of the pneumatically powered rodless cylinder mechanism 148, as well as the actuation of the piston-cylinder mechanism 138, is suitably controlled by means of a programmable logic controller (PLC) 150 which is mounted upon the downstream end of the machine or system framework or housing 120, and in this manner, the movements of the drive chain mechanisms 130, 130, in conjunction with the movements of the pusher-plate mechanism 142, can be appropriately coordinated. It is also noted that a suitable valve mechanism 151 is operatively associated with the pneumatically powered rodless cylinder mechanism 148 so as to effectively relieve the internal pneumatic pressure whereby the slide mechanism 144, and the pusher-plate mechanism 142 mounted thereon, can be manually moved to the rear or back end of the tote container workpiece magazine or hopper 112 in preparation for the loading of a new batch of tote container workpieces 11 therewithin.

Continuing still further, in order to positively maintain the plurality of tote container workpieces 11 at their positions within the tote container workpiece magazine or hopper 112 such that the lower end portions of the tote container workpieces 11 remain engaged with the drive chain mechanisms 130, 130, a hold-down bar 152 is disposed immediately above the upper edge portions of the plurality of tote container workpieces 11. The hold-down bar 152 is adapted to be pivotally movable between a first operative position, as illustrated within FIGS. 8-10, whereby the hold-down bar 152 is effectively engaged with, or disposed immediately above, the plurality of tote container workpieces 11 disposed within the tote container workpiece magazine or hopper 112, and a second inoperative position, such as, for example, 180° from the first illustrated operative position, so as to effectively permit new tote container workpieces 11 to be loaded into the tote container workpiece magazine or hopper 112. The pivotal movement of the hold-down bar 152 is achieved by means of a pair of pneumatically-controlled piston-cylinder mechanisms 154, only one of which is illustrated within FIG. 10. The piston-cylinder mechanisms 154 are respectively operatively connected to the hold-down bar 152 by means of a pair of longitudinally spaced actuator arms 156, 156 and linkage mechanisms 158, only one of which is likewise disclosed within FIG. 10, and the pneumatic power for the pair of piston-cylinder mechanisms 154 may be controlled by means of a suitable valve mechanism 160, similar to valve mechanism 151, as illustrated within FIGS. 8 and 9.

It is to be appreciated that the structural combination, comprising the drive-chain mechanisms 130, 130, the pusher-plate mechanism 142, and the hold-down bar 152, serves to properly confine and move each one of the plurality of tote container workpieces 11 within and through the tote container workpiece magazine or hopper 112 in a substantially vertical orientation such that each leading one of the tote container workpieces 11 can be serially presented to, and properly grasped by, the plurality of vacuum suction cup implements 114. In order to ensure the fact that each one of the tote container workpieces 11 is disposed within a vertical plane at the downstream or exit end of the tote container workpiece magazine or hopper 112 so as to enable the same to be individually and properly grasped by means of the plurality of vacuum suction cup implements 114, it is noted further that a pair of vertically spaced photodetector systems are disposed at the downstream or exit end of the tote container workpiece magazine or hopper 112. More particularly, as can best be seen in FIG. 10, a first upper phototransmitter 162 is provided for transmitting a first beam of light 163 across the conveyance path of the tote container workpieces 11, and a first upper photoreceiver 164 is provided for receiving such first beam of light 163. In a similar manner, a second lower phototransmitter 166 is likewise provided for transmitting a second beam of light 167 across the conveyance path of the tote container workpieces 11, and a second lower photoreceiver 168 is provided for receiving such second beam of light 167. The first upper phototransmitter 162, first beam of light 163, and first upper photoreceiver 164 are operatively connected to the rodless cylinder mechanism 148 through means of the programmable logic controller (PLC) 150, while the second lower phototransmitter 166, second beam of light 167, and second lower photoreceiver 168 are likewise operatively connected to the piston-cylinder mechanism 138 through means of the programmable logic controller (PLC) 150.

As can best be appreciated from FIGS. 8 and 9, the first and second phototransmitters 162, 166, and the first and second photoreceivers 164, 168 are all disposed within the same vertical plane which extend transversely across the downstream or exit end of the tote container workpiece magazine or hopper 112. In this manner, it can be further appreciated that if the first and second light beams 163, 167 are substantially simultaneously interrupted by means of the leading one of the tote container workpieces 11, whereby appropriate signals to such an effect will be transmitted to the programmable logic controller (PLC) 150, then it is known that the leading one of the tote container workpieces 11 is in fact properly disposed within a vertical plane. On the other hand, or conversely, if one of the light beams 163, 167 is interrupted prior to the interruption of the other one of the light beams 163, 167, then it is known, from the appropriate signals transmitted to the programmable logic controller (PLC) 150, that the leading one of the tote container workpieces 11 is not in fact properly disposed in a vertical plane whereby the programmable logic controller (PLC) 150 can appropriately activate the indexable piston-cylinder mechanism 138 for the drive-chain mechanisms 130, 130, or activate the rodless cylinder mechanism 148 for the pusher-plate mechanism 142, as is necessary, so as to effectively align the upper and lower end portions of the tote container workpiece 11 with respect to each other within a true vertical plane.

Continuing further, when the plurality of tote container workpieces 11 have been moved forwardly such that one of the tote container workpieces 11 is disposed at the downstream or exit end of the tote container workpiece magazine or hopper 112 so as to serve as the leading one of the tote container workpieces 11, then such leading one of the tote container workpieces 11 is now positioned so as to be capable of being grasped by means of the vacuum suction cup implements 114 whereby the vacuum suction cup implements 114 can effectively remove the leading one of the tote container workpieces 11 from the serial array of tote container workpieces 11 disposed within the tote container workpiece magazine or hopper 112 and thereby begin the erection or assembly process to be performed upon such tote container workpiece 11. More particularly, it is seen that vacuum suction cup implements 114 actually comprise, for example, four vacuum suction cup implements which are arranged within a substantially rectangular array as can best be appreciated from FIG. 10. The vacuum suction cup implements 114 are mounted upon the upper end portion of an upstanding plate or arm 170, and the lower end portion of the upstanding plate or arm 170 is fixedly mounted upon a slide mechanism 172. The slide mechanism 172 is similar to the slide mechanism 144 and is accordingly slidably mounted upon a track member 174 which is effectively defined within the upper surface portion a pneumatically powered rodless cylinder mechanism 176. As was the case with the slide mechanism 144 and the pneumatically powered rodless cylinder mechanism 148, the slide mechanism 172 and the pneumatically powered rodless cylinder mechanism 176 are under the control of the programmable logic controller (PLC) 150.

Accordingly, as can be readily appreciated from FIGS. 8 and 9, when the rodless cylinder mechanism 176 is actuated so as to effectively move the slide mechanism 172 toward the left as viewed within FIGS. 8 and 9, the vacuum suction cup implements 114 will likewise be moved toward the left, as viewed within FIGS. 8 and 9, so as to be positioned immediately adjacent to and in substantial surface contact with the external surface portion of the leading one of the tote container workpieces 11 which is disposed at the downstream end or exit of the tote container workpiece magazine or hopper 112. Still further, when vacuum is supplied to the vacuum suction cup implements 114 from a suitable source of vacuum, not shown, under the influence or control of the programmable logic controller (PLC) 150, the vacuum suction cup implements 114 will cause the leading one of the tote container workpieces 11 to be attracted toward, and be adhered to, the vacuum suction cup implements 114. Accordingly, when the rodless cylinder mechanism 176 is then actuated so as to effectively move the slide mechanism 172 toward the right as viewed within FIGS. 8 and 9, so as to likewise move the vacuum suction cup implements 114, and the leading one of the tote container workpieces 11 adhered thereon, toward the right as viewed within FIGS. 8 and 9, the leading one of the tote container workpieces 11 will be effectively withdrawn or removed from the tote container workpiece magazine or hopper 112 and separated from the remaining ones of the tote container workpieces 11 disposed within the tote container workpiece magazine or hopper 112.

It is noted still further that, in order to ensure the serial, individual separation of the leading one of the tote container workpieces 11 from the remaining or residual ones of the tote container workpieces 11 disposed within the tote container workpiece magazine or hopper 112, a suitable gate mechanism, not shown, may be operatively associated with the downstream or exit end of the tote container workpiece magazine or hopper 112. While the gate mechanism per se is not shown in the drawings, the gate mechanism may alternatively comprise either a reciprocally movable mechanism or a pivotally movable mechanism which may be actuated by means of a suitable pneumatically-controlled piston-cylinder gate actuator 178, as illustrated within FIG. 8, and the pneumatic piston-cylinder gate actuator 178 is adapted to be operatively connected to the programmable logic controller (PLC) 150 so as to be properly and timely controlled thereby. It can therefore be readily appreciated that a suitably timed, sequentially conducted actuation cycle for the gate actuator 178 will comprise, for example, the movement of the gate mechanism, not shown, to a first, extended operative position wherein the gate mechanism, not shown, will be interposed between the leading one of the tote container workpieces 11 and the next succeeding one of the tote container workpieces 11 disposed within the tote container workpiece magazine or hopper 112 such that when the suction cup implements 114 are actuated, only the leading one of the tote container workpieces 11 will in fact be withdrawn or removed from the downstream or exit end of the tote container workpiece magazine or hopper 112 while the remaining ones of the tote container workpieces 11 will in fact be effectively retained within the tote container workpiece magazine or hopper 112 by means of the aforenoted gate mechanism, not shown.

Subsequently, after such leading one of the tote container workpieces 11 has in fact been withdrawn or removed from the downstream or exit end of the tote container workpiece magazine or hopper 112 by means of the vacuum suction cup implements 114, the gate actuator 178 can be actuated so as to move the gate mechanism, not shown, to a second, retracted, inoperative position whereby the serial array of tote container workpieces 11, disposed within the tote container workpiece magazine or hopper 112, can be incrementally or indexably advanced so as to effectively dispose a new leading one of the tote container workpieces 11 at the downstream or exit end of the tote container workpiece magazine or hopper 112. The gate actuator 178 can then be accordingly actuated so as to return the gate mechanism, not shown, to its first, extended operative position so as to once again be interposed between the leading one of the tote container workpieces 11 and the next succeeding one of the tote container workpieces 11 disposed within the tote container workpiece magazine or hopper 112 in preparation for the next operative cycle.

Continuing further, as the vacuum suction cup implements 114 move the leading one of the tote container workpieces 11 toward the work station, as disclosed within FIGS. 8 and 9, at which the tote container workpiece 11 will be assembled or erected into the finalized tote container, the tote container workpiece 11 will encounter the dual-roller mechanism or assembly 116 as has been schematically illustrated within FIGS. 3*c* and 3*d*.More particularly, it is seen that the dual-roller mechanism or assembly 116 is disposed substantially immediately downstream of the downstream or exit end of the tote container workpiece magazine or hopper 112 and is also disposed toward one side of the flow path DS along which the leading one of the tote container workpieces 11 is moved by means of the vacuum suction cup implements 114. In addition, it is further seen that the dual-roller mechanism or assembly 116 comprises a first-stage opening roller 180 and a second-stage opening roller 182, wherein the first-stage and second-stage opening rollers 180, 182 are mounted upon opposite ends of a connecting bar 184 such that the second-stage opening roller 182 is disposed closer to the vacuum suction cup implements 114 than is the first-stage opening roller 180. Accordingly, as can be readily appreciated from FIGS. 3*c*, 3*d*, and 9, as the leading one of the tote container workpieces 11 is moved along the flow path DS as a result of the side wall portion 16 of the tote container workpiece 11 effectively being adhered upon the vacuum suction cup implements 114, the end wall portion 14 of the tote container workpiece 11 will encounter the first-stage opening roller 180.

Due to the fact that the first-stage opening roller 180 is positionally fixed with respect to the flow path DS, the end wall portion 14 of the tote container workpiece 11 cannot simply move past the first-stage opening roller 180 in a translational manner, but to the contrary, as the plurality of vacuum suction cup implements 114 cause the side wall portion 16 to move forwardly along the flow path DS, whereby the tote container workpiece 11 begins to open from its FLATTENED state toward its EXPANDED state, the end wall portion 14 of the tote container workpiece 11, momentarily restrained as a result of its encounter with the first-stage opening roller 180, will effectively be caused to slide along and past the first-stage opening roller 180 as disclosed within FIG. 3*c*. Eventually, as can be appreciated from a comparison between FIGS. 3*c* and 3*d*, the corner portion 26 of the tote container workpiece 11, as defined between the end and side wall portions 14, 16 of the tote container workpiece 11, will move toward the second-stage opening roller 182 such that the end wall portion 14 of the tote container workpiece 11 will subsequently engage the second-stage opening roller 182. Consequently, as a result of the operative intercooperation defined between the second-stage opening roller 182 and the plurality of vacuum suction-cup implements 114, the tote container workpiece 11 will effectively be fully opened to, and retained at, its EXPANDED state such that the EXPANDED tote container workpiece 11 now has a substantially squared-up rectangular configuration as disclosed within FIGS. 3*d* and 9. The tote container workpiece 11, now disposed in its fully and properly EXPANDED state, is ready to be completely erected or assembled in accordance with the sequential method as has been previously schematically illustrated within FIGS. 4*a*-7*b*.

Accordingly, with reference being made to FIGS. 8 and 9, it is initially noted that first, second, and third folding mechanisms 186, 188, 190, which are adapted to be respectively powered or activated by means of pneumatically-controlled piston-cylinder actuators 192, 194, 196 under the timely and sequential control of the programmable logic controller (PLC) 150, are disposed upon the side and opposite ends of the EXPANDED tote container workpiece 11, as can best be seen in FIG. 9. In this manner, the folding mechanisms 186, 188, 190 can respectively engage and fold the bottom surface flap members 78, 70, 90 of the tote container workpiece 11 upwardly and inwardly with respect to the bottom edge portions 80, 72, 92 of the side and end wall portions 16, 14, 18 of the tote container workpiece 11 in accordance with the folding sequence as previously disclosed and described in connection with FIGS. 4*a*-5*b*.

Still further, a pair of additional folding mechanisms 198, 200, which are likewise adapted to be respectively powered or activated by means of pneumatically-controlled piston-cylinder actuators 202, 204 under the timely and sequential control of the programmable logic controller (PLC) 150, are effectively disposed opposite the folding mechanism 186 and its associated piston-cylinder actuator 192, as can best be seen in FIG. 8. In this manner, the folding mechanisms 198, 200 can sequentially engage and fold the bottom surface flap member 62 of the tote container workpiece 11 upwardly and inwardly with respect to the bottom edge portion 64 of the side wall portion 12 of the tote container workpiece 11, as well as with respect to the previously folded bottom surface flap members 78, 70, 90, in the aforenoted three-stage manner so as to effectively interlock the bottom surface flap member 62 with respect to the bottom surface flap member 78 in accordance with the folding sequence as previously disclosed and described in connection with FIGS. 6*a*-7*b*.In particular, the folding mechanism 198 is utilized to achieve the first stage 45° angular movement of the bottom surface flap member 62 as disclosed within FIGS. 6*a*, 6*b*, while the folding mechanism 200 is utilized to achieve the second and third stage 45° angular movements of the bottom surface flap member 62 as has been described in connection with FIGS. 7*a*, 7*b*. In this manner, the bottom surface flap members 62, 70, 78, 90 are now all intermeshed, interengaged, and interlocked together, as has been previously disclosed and described, whereby assembly or erection of the tote container has now been completed, the assembled or erected tote container being disclosed at 205 within FIG. 10.

Since the exemplary tote container 205 has now been completely assembled or erected, the erected or assembled tote container 205 must be removed from the assembly or erection workstation in order to permit the erection or assembly of a subsequent tote container. Accordingly, as can further be appreciated from FIG. 10, a pneumatically-controlled piston-cylinder mechanism 206 is operatively connected to the dual-roller mechanism 116, through means of a suitable linkage mechanism 208, so as to effectively move the dual-roller mechanism 116 from its illustrated operative position, at which the second-stage roller 182 is disposed in contact with the end wall portion 14 of the assembled or erected tote container 205, to a retracted or remotely located inoperative position, not illustrated, in accordance with timely transmitted signals from the programmable logic controller (PLC) 150. In this manner, the completely assembled or erected tote container 205 is now free to be moved, toward the right as illustrated within FIG. 10, from the erection or assembly workstation, defined internally within the machine or system framework or housing 120, to a position externally of the machine or system framework or housing 120, as illustrated at 205'. In order to actually implement the aforenoted movement of the completed tote container 205, it is noted still further that a pusher-plate mechanism 210 is adapted to engage the opposite end wall portion 18 of the completed tote container 205. The pusher-plate mechanism 210 is mounted upon a substantially L-shaped mounting bracket 212, and the mounting bracket 212 is, in turn, fixedly mounted upon the underside portion of a pneumatically-powered rodless cylinder assembly 214 through means of a slide mechanism 216. Accordingly, when particularly timed signals are received from the programmable logic controller (PLC) 150, which will be transmitted to the pneumatically-powered rodless cylinder assembly 214 after, for example, the programmable logic controller (PLC) 150 has received appropriate confirmation signals, from the pneumatically-controlled piston-cylinder actuators 192, 194, 196, to the effect that the various pneumatically-controlled piston-cylinder actuators 192, 194, 196, and their operatively associated folding mechanisms 186, 188, 190, have in fact completed their erection or assembly operations, then the rodless cylinder assembly 214 will be actuated so as to cause the operatively associated pusher-plate mechanism 210 thereof to move the completed tote container 205 to its discharged position 205'. It is lastly noted that the apparatus or system 110 of the present invention is also provided with suitable control panels or the like 218, 220 which may comprise a plurality of suitable control buttons, such as, for example, START, NORMAL STOP, SEQUENCE, EMERGENCY STOP, and the like.

Thus, it may be seen that in accordance with the principles and teachings of the present invention, a new and improved apparatus or system for automatically assembling or erecting tote containers, and a corresponding method or process for practicing or implementing the assembly or erection of the tote containers, has been developed wherein a plurality of tote container workpieces are initially disposed in a FLATTENED state and in a serial array within a magazine or hopper. The tote container workpieces are individually removed from the magazine or hopper in a serial manner and each one of the tote container workpieces is then automatically expanded from its FLATTENED state to an OPENED or EXPANDED state. Subsequently, the flap members are folded upwardly and inwardly, with respect to the lower or bottom edge portions of the four integrally connected side and end walls of each tote container workpiece, in accordance with a predetermined procedural sequence whereby each tote container is automatically assembled as a result of the flap members being engaged with each other in an intermeshed, interengaged, and interlocked manner so as to effectively form the bottom support surface of the tote container without the need for fixing, bonding, or otherwise permanently securing the flap members together. Accordingly, each tote container is then capable of being used, and as may be subsequently desired or required, and in view of the fact that the flap members are not fixed, bonded, or otherwise permanently secured together, the tote containers may be readily disassembled by disengaging or unlocking the flap members from or with respect to each other. In this manner, the disassembled tote containers can be shipped to other locations at which, for example, the tote containers can be reused, or alternatively, the disassembled tote containers can effectively be recycled as a result of the thermoplastic tote containers being melted and re-fabricated when, for example, the structural integrity of the original tote containers may be compromised as a result of the original tote containers having effectively reached the ends of their service lives.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A system comprising a tote container workpiece, and apparatus for automatically erecting the tote container workpiece from an originally FLATTENED state to an EXPANDED state so as to define a tote container, comprising:

a plurality of tote container workpieces wherein each tote container workpiece is defined by means of a pair of oppositely disposed end walls, a pair of oppositely disposed side walls, and a plurality of bottom surface flap members respectively pivotally connected to lower edge portions of said pair of oppositely disposed end walls and said pair of oppositely disposed side walls;

a hopper for housing said plurality of tote container workpieces in substantially FLATTENED states, and in a serial array, in preparation for respectively erecting said plurality of tote container workpieces from said FLATTENED state to said EXPANDED state, wherein said hopper has an open end portion through which leading ones of said plurality of tote container workpieces, disposed within said hopper, can be individually withdrawn from said hopper in a serial manner;

roller engaging means, disposed substantially immediately adjacent to said open end portion of said hopper, for engaging one of said pair of oppositely disposed end walls of said leading one of said plurality of tote container workpieces, disposed within said hopper, when said leading one of said plurality of tote container workpieces is withdrawn from said open end portion of said hopper;

means, comprising a plurality of vacuum suction cup implements disposed adjacent to said hopper and movable from a first position, disposed adjacent to said hopper, to a second position, disposed at a work station at which said plurality of tote container workpieces can be individually erected from said plurality of tote container workpieces to tote containers, for grasping one of the pair of oppositely disposed side walls of said leading one of said plurality of tote container workpieces, disposed within said hopper, such that as said grasping means moves from said first position to said second position so as to withdraw said leading one of said plurality of tote container workpieces from said hopper, said one of said pair of oppositely disposed end walls of said FLATTENED, leading one of said plurality of tote container workpieces is moved into contact with said roller engaging means, disposed substantially immediately adjacent to said open end portion of said hopper, so as to effectively be positionally restrained by said roller engaging means whereby continued movement of said grasping means toward said second position will cause said grasping means and said roller engaging means to cooperate together so as to cause said leading one of said plurality of tote container workpieces, withdrawn from said hopper, to roll along said roller engaging means and attain said EXPANDED state;

said roller engaging means comprising a first-stage roller for initially engaging and partially restraining said leading one of said plurality of tote container workpieces, as said grasping means, for individually and serially withdrawing said plurality of tote container workpieces from said hopper, withdraws said leading one of said plurality of tote container workpieces from said hopper and moves said leading one of said plurality of tote container workpieces toward said work station such that said leading one of said plurality of tote container workpieces will begin to expand from said substantially FLATTENED state to said EXPANDED state, and a second-stage roller for subsequently engaging said leading one of said plurality of tote container workpieces, as said grasping means, for individually and serially withdrawing said plurality of tote container workpieces from said hopper, moves said leading one of said plurality of tote container workpieces toward said work station, such that said leading one of said plurality of tote container workpieces will be fully expanded to said EXPANDED state; and means for pivotally moving said plurality of bottom surface flap members of said EXPANDED tote container workpiece with respect to said lower edge portions of said pair of oppositely disposed end walls and said pair of oppositely disposed side walls of said tote container workpiece in a predetermined sequential manner from first positions, at which said plurality of bottom surface flap members are not operatively engaged with each other, to second positions at which said plurality of bottom surface flap members are operatively engaged with each other in an interlocked manner so as to define the bottom surface portion of said tote container without the need for permanently securing said plurality of bottom surface flap members together and thereby completing said erection of said tote container workpiece to said tote container.

2. The system as set forth in claim 1, wherein said means for pivotally moving the plurality of bottom surface flap members, with respect to the lower edge portions of the pair of oppositely disposed end walls and the pair of oppositely disposed side walls, comprises:

a plurality of folding mechanisms for respectively engaging the plurality of bottom surface flap members; and a plurality of actuators operatively connected to said plurality of folding mechanisms for moving said plurality of folding mechanisms such that said plurality of folding mechanisms can move the plurality of bottom surface flap members from the first positions, at which the plurality of bottom surface flap members are not operatively engaged with each other, to the second positions at which the plurality of bottom surface flap members are operatively engaged with each other in the interlocked manner so as to define the bottom surface portion of the tote container.

3. The system as set forth in claim 2, wherein said means for pivotally moving the plurality of bottom surface flap members, with respect to the lower edge portions of the pair of oppositely disposed end walls and the pair of oppositely disposed side walls, in the predetermined sequential manner from the first positions at which the plurality of bottom surface flap members are not operatively engaged with each other to the second positions at which the plurality of bottom surface flap members are operatively engaged with each other in the interlocked manner so as to define the bottom surface portion of the tote container, comprises:

means for folding a first one of the bottom surface flap members connected to a first side wall of the tote container;

means for folding the bottom surface flap members connected to the pair of end walls of the tote container; and means for folding the second one of the bottom surface flap members connected to the second side wall of the tote container such that the first one of the bottom surface flap members connected to the first side wall of the tote container overlaps the bottom surface flap members connected to the pair of end walls of the tote container, the bottom surface flap members connected to the pair of end walls of the tote container overlap the second one of the bottom surface flap members connected to the second side wall of the tote container, and the second one of the bottom surface flap members connected to the second side wall of the tote container overlaps the first one of the bottom surface flap members connected to the first side wall of the tote container.

4. The system as set forth in claim 2, wherein said means for pivotally moving the plurality of bottom surface flap members, with respect to the lower edge portions of the pair of oppositely disposed end walls and the pair of oppositely disposed side walls, in the predetermined sequential manner from the first positions at which the plurality of bottom surface flap members are not operatively engaged with each other to the second positions at which the plurality of bottom surface flap members are operatively engaged with each other in the interlocked manner so as to define the bottom surface portion of the tote container, comprises:

means for folding a first one of the bottom surface flap members connected to a first side wall of the tote container from a substantially vertical orientation to a substantially horizontal orientation;

means for folding the bottom surface flap members connected to the pair of end walls of the tote container from substantially vertical orientations to substantially horizontal orientations; and means for folding the second one of the bottom surface flap members connected to the second side wall of the tote container from a substantially vertical orientation to a position beyond a horizontal orientation so as to bias the first one of the bottom surface flap members away from its substantially horizontal orientation until the first one of the bottom surface flap members reaches a predetermined position at which the first one of the bottom surface flap members snaps back to its horizontal orientation such that the first one of the bottom surface flap members connected to the first side wall of the tote container overlaps the bottom surface flap members connected to the pair of end walls of the tote container, the bottom surface flap members connected to the pair of end walls of the tote container overlap the second one of the bottom surface flap members connected to the second side wall of the tote container, and the second one of the bottom surface flap members connected to the second side wall of the tote container overlaps the first one of the bottom surface flap members connected to the first side wall of the tote container, whereby the plurality of bottom surface flap members are operatively engaged with each other in the interlocked manner.

5. The system as set forth in claim 1, further comprising:

means for moving the plurality of tote container workpieces within said hopper so as to dispose the leading one of the plurality of tote container workpieces at said open end portion of said hopper at which said grasping means, for individually and serially withdrawing the plurality of tote container workpieces from said hopper, can withdraw and move the leading one of the plurality of tote container workpieces from said open end portion of said hopper toward said work station.

6. The system as set forth in claim 5, wherein said means for moving the plurality of tote container workpieces within said hopper comprises:

a chain drive mechanism for movably supporting lower edge portions of the plurality of tote container workpieces disposed within said hopper; and a pusher mechanism for engaging a rear surface portion of the rearwardmost tote container workpiece disposed within said hopper so as to operatively cooperate with said chain drive mechanism in moving the plurality of tote container workpieces toward said open end portion of said hopper.

7. The system as set forth in claim 6, further comprising:

photodetector means disposed at said open end portion of said hopper for determining the vertical disposition of the plurality of tote container workpieces within said hopper and operatively associated with said chain drive and pusher mechanisms; and programmable logic controller (PLC) means operatively connected to said photodetector means, and said chain drive and pusher mechanisms, for controlling said chain drive and pusher mechanisms in accordance with signals received from said photodetector means so as to ensure the vertical disposition of the plurality of tote container workpieces within said hopper.

8. The system as set forth in claim 1, further comprising:

means disposed with said hopper for engaging the plurality of tote container workpieces disposed within said hopper so as to ensure that the plurality of tote container workpieces can only be disposed within said hopper in a predetermined orientation in order to properly dispose the tote container workpieces for proper erection into the plurality of tote containers.

9. The system as set forth in claim 8, wherein:

said means, disposed with said hopper for engaging the plurality of tote container workpieces disposed within said hopper so as to ensure that the plurality of tote container workpieces can only be disposed within said hopper in a predetermined orientation, comprises a longitudinally extending tote container workpiece orientation bar for engaging a slotted portion of each one of the plurality of tote container workpieces disposed within said hopper.

10. The system as set forth in claim 9, wherein:

said tote container workpiece orientation bar is disposed within said hopper at an off-center position with respect to the lateral extent of said hopper such that the plurality of tote container workpieces must be disposed within said hopper with a proper front-to-back orientation.

11. The system as set forth in claim 1, wherein:

said means for pivotally moving the plurality of bottom surface flap members of the EXPANDED tote container workpiece with respect to the lower edge portions of the pair of oppositely disposed end walls and the pair of oppositely disposed side walls of the tote container workpiece in a predetermined sequential manner from first positions, at which the plurality of bottom surface flap members are not operatively engaged with each other, to second positions, at which the plurality of bottom surface flap members are operatively engaged with each other in an interlocked manner, comprises means for folding a first one of the bottom surface flap members pivotally connected to the lower edge portion of a first one of the oppositely disposed side walls of the tote container workpiece, means for folding second and third ones of the bottom surface flap members, pivotally connected to the lower edge portions of the oppositely disposed end walls of the tote container workpiece, subsequent to the folding of the first one of the bottom surface flap members of the tote container workpiece, and means for lastly folding a fourth one of the bottom surface flap members pivotally connected to the lower edge portion of a second one of the oppositely disposed side walls of the tote container workpiece so as to be interlocked only with the first oppositely disposed one of the bottom surface flap members pivotally connected to the lower edge portion of the first one of the oppositely disposed side walls of the tote container workpiece so as to define the bottom surface portion of an erected tote container without the need for permanently securing the plurality of bottom surface flap members together.

12. A method for automatically erecting a tote container, having an EXPANDED state, from an originally FLATTENED tote container workpiece, comprising the steps of:

providing a plurality of tote container workpieces wherein each one of said plurality of tote container workpieces is defined by means of a pair of oppositely disposed end walls, a pair of oppositely disposed side walls, and a plurality of bottom surface flap members respectively pivotally connected to lower edge portions of the pair of oppositely disposed end walls and the pair of oppositely disposed side walls;

housing said plurality of tote container workpieces, in substantially FlATTENED states and in a serial array, within a hopper in preparation for respectively erecting said plurality of tote containers from said plurality of tote container workpieces, wherein said hopper has an open end portion through which leading ones of said plurality of tote container workpieces, disposed within said hopper, can be individually withdrawn from said hopper in a serial manner;

positioning roller engaging means, at a location substantially immediately adjacent to said open end portion of said hopper, for engaging one of said pair of oppositely disposed end walls of said leading one of said plurality of tote container workpieces, which are disposed within said hopper, when said leading one of said plurality of tote container workpieces is being withdrawn from said open end portion of said hopper, wherein said roller engaging means comprised a dual-roller mechanism such that a first-stage roller is used for initially engaging and partially restraining said leading one of said plurality of tote container workpieces, as said grasping means, for individually and serially withdrawing said plurality of tote container workpieces from said hopper, withdraws said leading one of said plurality of tote container workpieces from said hopper and moves said leading one of said plurality of tote container workpieces toward said work station such that said leading one of said plurality of tote container workpieces will begin to expand from said substan-tially FLATTENED state to said EXPANDED state, while a second-stage roller is used for subsequently engaging said leading one of said plurality of tote container workpieces, as said grasping means, for individually and serially withdrawing said plurality of tote container workpieces from said hopper, moves said leading one of said plurality of tote container workpieces toward said work station, such that said leading one of said plurality of tote container workpieces will be fully expanded to said EXPANDED state;

using a grasping means, comprising a plurality of vacuum suction cup implements disposed adjacent to said hopper, so as to grasp one of said pair of oppositely disposed side walls of said leading one of said plurality of tote container workpieces disposed within said hopper;

moving said grasping means from a first position, disposed adjacent to said hopper, to a second position, disposed at a work station at which said plurality of tote container workpieces can be individually erected from said plurality of tote container workpieces to said tote containers, so that said leading one of said plurality of tote container workpieces is withdrawn from said hopper in such a manner that one of said pair of oppositely disposed end walls of said FLATTENED, leading one of said plurality of tote container workpieces will be moved into contact with said roller engaging means, disposed substantially immediately adjacent to said open end portion of said hopper, so as to effectively be positionally restrained by said roller engaging means whereby continued movement of said grasping means toward said second position will cause said grasping means and said roller engaging means to cooperate together so as to cause said leading one of said plurality of tote container workpieces, withdrawn from said hopper, to roll along said roller engaging means and be OPENED so as to attain said EXPANDED state; and pivotally moving the plurality of bottom surface flap members of the EXPANDED tote container workpiece with respect to the lower edge portions of the pair of oppositely disposed end walls and the pair of oppositely disposed side walls of the tote container workpiece in a predetermined sequential manner from first positions, at which the plurality of bottom surface flap members are not operatively engaged with each other, to second positions at which the plurality of bottom surface flap members are operatively engaged with each other in an interlocked manner, so as to define the bottom surface portion of said tote container without the need for permanently securing said plurality of bottom surface flap members together and thereby completing said erection of said tote container workpiece to said tote container.

13. The method as set forth in claim 12, further comprising the steps of:

folding a first one of the bottom surface flap members connected to a first side wall of the tote container;

folding the bottom surface flap members connected to the pair of end walls of the tote container; and folding the second one of the bottom surface flap members connected to the second side wall of the tote container such that the first one of the bottom surface flap members connected to the first side wall of the tote container overlaps the bottom surface flap members connected to the pair of end walls of the tote container, the bottom surface flap members connected to the pair of end walls of the tote container overlap the second one of the bottom surface flap members connected to the second side wall of the tote container, and the second one of the bottom surface flap members connected to the second side wall of the tote container overlaps the first one of the bottom surface flap members connected to the first side wall of the tote container.

14. The method as set forth in claim 12, further comprising the steps of:

folding a first one of the bottom surface flap members connected to a first side wall of the tote container from a substantially vertical orientation to a substantially horizontal orientation;

folding the bottom surface flap members connected to the pair of end walls of the tote container from substantially vertical orientations to substantially horizontal orientations; and folding the second one of the bottom surface flap members connected to the second side wall of the tote container from a substantially vertical orientation to a position beyond a horizontal orientation so as to bias the first one of the bottom surface flap members away from its substantially horizontal orientation until the first one of the bottom surface flap members reaches a predetermined position at which the first one of the bottom surface flap members snaps back to its horizontal orientation such that the first one of the bottom surface flap members connected to the first side wall of the tote container overlaps the bottom surface flap members connected to the pair of end walls of the tote container, the bottom surface flap members connected to the pair of end walls of the tote container overlap the second one of the bottom surface flap members connected to the second side wall of the tote container, and the second one of the bottom surface flap members connected to the second side wall of the tote container overlaps the first one of the bottom surface flap members connected to the first side wall of the tote container, whereby the plurality of bottom surface flap members are operatively engaged with each other in the interlocked manner.

15. The method as set forth in claim 12, further comprising the steps of:

first folding a first one of the bottom surface flap members pivotally connected to the lower edge portion of a first one of the oppositely disposed side walls of the tote container workpiece;

subsequently folding second and third ones of the bottom surface flap members pivotally connected to the lower edge portions of the oppositely disposed end walls of the tote container workpiece; and lastly folding a fourth one of the bottom surface flap members pivotally connected to the lower edge portion of a second one of the oppositely disposed side walls of the tote container workpiece so as to be interlocked only with the first oppositely disposed one of the bottom surface flap members pivotally connected to the lower edge portion of the first one of the oppositely disposed side walls of the tote container workpiece so as to define the bottom surface portion of an erected tote container without the need for permanently securing the plurality of bottom surface flap members together.

16. The method as set forth in claim 12, further comprising the step of:

disposing means within said hopper for engaging the plurality of tote container workpieces disposed within said hopper so as to ensure that the plurality of tote container workpieces can only be disposed within said hopper in a predetermined orientation in order to properly dispose the tote container workpieces for proper erection into the plurality of tote containers.

17. The system as set forth in claim 1, further comprising:

means for discharging the erected tote container from said work station so as to permit a subsequent tote container workpiece to be erected into a tote container.

* * * * *